United States Patent [19]

Zander

[11] Patent Number: 4,759,308

[45] Date of Patent: Jul. 26, 1988

[54] SEALING LIP ASSEMBLY FOR SURFBOARDS AND SAILBOATS

[75] Inventor: Wolf-Dietrich Zander, Mielkendorf, Fed. Rep. of Germany

[73] Assignee: F2 International Gesellschaft m.b.H., Wals, Austria

[21] Appl. No.: 886,162

[22] Filed: Jul. 16, 1986

[30] Foreign Application Priority Data

Jul. 17, 1985 [DE] Fed. Rep. of Germany ..... 3525491

[51] Int. Cl.[4] ..... B63B 41/00

[52] U.S. Cl. ..... 114/127; 114/133; 114/140; 114/141

[58] Field of Search ..... 114/127–141, 114/39.2, 39.1; 441/74, 79; 16/2; 49/480, 481; 277/207 R, 209; 267/152

[56] References Cited

U.S. PATENT DOCUMENTS 3,730,509 5/1973 Jorn ..... 267/152
3,873,077 3/1975 Jorn ..... 267/152

FOREIGN PATENT DOCUMENTS 3440553 3/1985 Fed. Rep. of Germany ..... 441/74

*Primary Examiner*—Sherman D. Basinger
*Attorney, Agent, or Firm*—Bacon & Thomas

[57] ABSTRACT

A sealing lip assembly for surfboards or sailboats, which closes the underwater side of the opening of the centerboard case or fin case in a virtually flow-tight and non-vortical manner in every position of the centerboard, and including two sealing lips, with each lip defined by a sealing area capable of flexing along the longitudinal axis of the assembly, a resilient area perpendicular to the longitudinal axis, and a mounting portion.

8 Claims, 2 Drawing Sheets

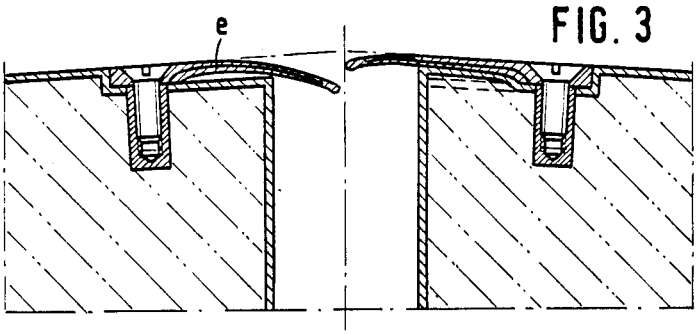
FIG. 3
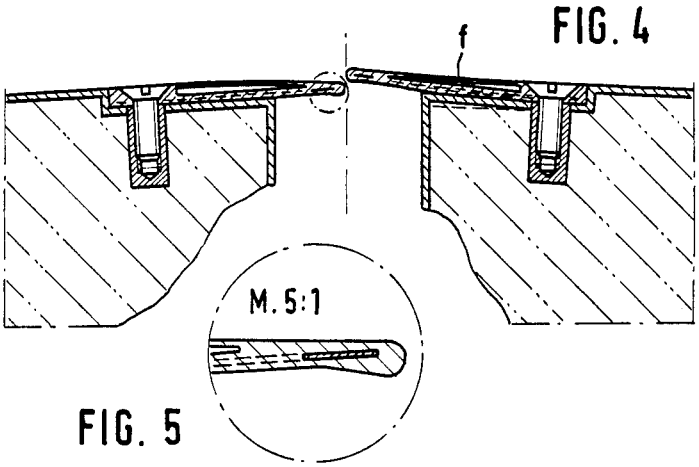
FIG. 4
FIG. 5
FIG. 6
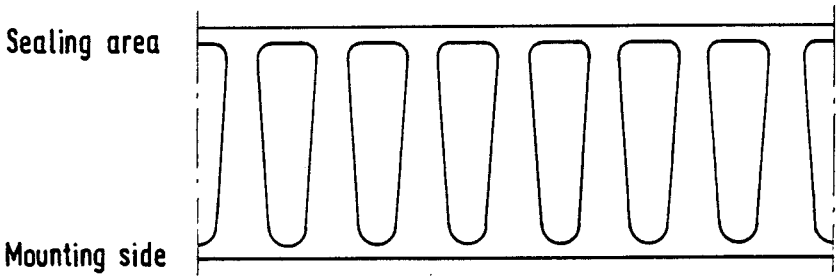

SEALING LIP ASSEMBLY FOR SURFBOARDS AND SAILBOATS

BACKGROUND OF THE INVENTION

1. Field of the Invention

The present invention relates to a sealing lip assembly for sealing the underwater or bottom side of centerboard or variable keel fin systems on surfboards and sailboats.

2. Description of the Prior Art

Various seals are used today for sealing the underwater or bottom side of centerboard systems on surfboards and sailboats, but they do not completely fulfil their function of closing the opening in the centerboard case in a flow-tight and non-vortical manner in every position of the centerboard.

These seals are made, for example, of rubber, plasticized PVC or sailcloth which is screwed or glued to the surfboard or sailboat by the aid of thin ledges. The advantage of these materials is that the centerboard can be pressed out of the centerboard case without great expenditure of energy because the resistance against being bent up is small. However, during sailing or surfing the small resistance allows for the sealing lips to be pressed in undesirably or, when the oncoming flow is lateral, to be raised up in the slack area, giving rise to vortices on the bottom of the boat or board. When the centerboard is pivoted into the centerboard case, the sealing lips are increasingly drawn into the centerboard case at the rear and cannot form a continuous transition from the bottom of the boat or board to the centerboard.

Soft rubber or synthetic seals are glued to the surfboard but are often detached and tear during surfing. Furthermore, the known seals cannot be adapted without any transition to the shape of the sliding bottom in mass production.

For these reasons, sealing lips are dispensed with today in many surfboards having fully lowerable centerboard systems, the centerboard case being profiled so as to be as favorable to flow as possible.

SUMMARY OF THE INVENTION

The invention is based on the problem of closing the bottom side of the centerboard case or fin case in a virtually flow-tight and non-vortical manner in every position of the centerboard of fin.

This problem is solved according to the invention by having the sealing lip assembly comprise two sealing lips, said sealing lips consisting of a sealing area flexible on the longitudinal axis, a resilient area perpendicular to the longitudinal axis, and a mounting portion.

When the centerboard is introduced into the centerboard case (from above) the sealing lips are pressed apart downwardly when the centerboard passes through the bottom opening in the centerboard case. When the centerboard is then pivoted rearwardly into the centerboard case, the sealing lips rise up against the pivoting direction, due to the bias in the pressed apart area, thereby closing off the opening in the centerboard case in a virtually flow-tight and non-vortical manner in every position of the centerboard.

Some embodiments of the invention are shown in the drawings and shall be described in more detail as follows.

BRIEF DESCRIPTION OF THE DRAWINGS

FIG. 3 is a transverse cross-section of the centerboard case, and disposed perpendicular to the longitudinal axis of the case (on the left: unsupported sealing lip; on the right: supported sealing lip);

FIG. 4 is a transverse cross-section of the centerboard case, and disposed perpendicular to the longitudinal axis of the case (on the left: unbiassed state; on the right: biassed state);

FIG. 5 is an enlargement of a detail in FIG. 4 in the sealing area; and

FIG. 6 is a perforated spring band steel insert.

DETAILED DESCRIPTION OF THE PREFERRED EMBODIMENTS

To support the optimum sealing lip function it is advantageous for the sealing lip to be slightly biassed in the installed state. Furthermore, the centerboard should be designed in the pivoted-in state in such a way as to produce a further slight bias of the sealing lip along the entire length.

Figure 1:
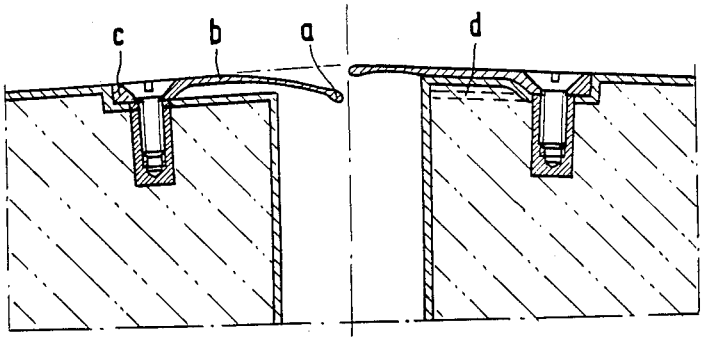
FIG. 1 is a transverse cross-section of the centerboard case as disposed perpendicular to the longitudinal axis of the case (on the left: unsupported sealing lip; on the right: supporting sealing lip)
Figure 2:
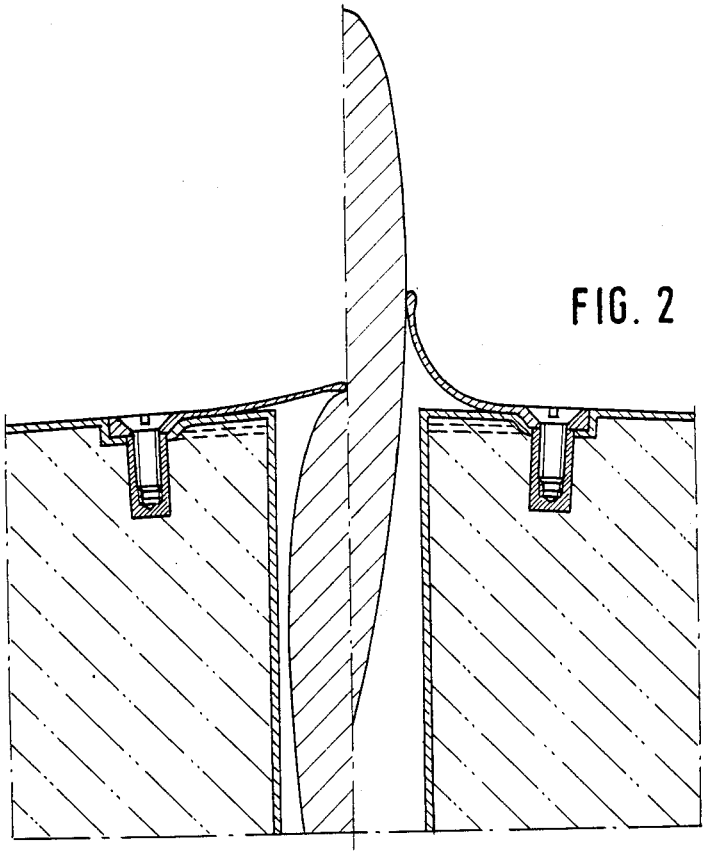
FIG. 2 is a transverse cross-section of the centerboard case and the centerboard, and disposed perpendicular to the longitudinal axis of the case (on the left: retracted centerboard position; on the right: extended centerboard position)

The recess in the centerboard case should be adapted as exactly as possible to the shape of the centerboard in the longitudinal direction so that the centerboard may pivot about a horizontal axis, as shown in all embodiments depicted herein, and does not overtax the spring force of the seal in the rear portion when the oncoming flow is lateral. As shown in FIG. 1 wherein the centerboard case is depicted with the bottom thereof being directed upwardly, as is the case for all embodiments depicted herein, a support (d) of the seal, which extends as far as the bottom opening in the centerboard case and at the same produces a slight bias of the seal, prevents the seal from being pressed into the centerboard case since the spring area of the profile decreases toward the rear in the pivoting-in direction due to the support. In the pivoting-out direction the spring area remains constant along the entire length, allowing for the centerboard to be pivoted out easily. As is apparent from FIGS. 1 and 3, the left-hand portions of these figures depict embodiments of the invention wherein no support (d) is provided for imparting a slight upward bias to the sealing lip in each case, thereby causing the sealing area (a) of each lip to dip downwardly into the case opening when the centerboard or keel fin is pivoted into the case. By contrast, the embodiments of the invention shown in the right-hand portions of FIGS. 1 and 3 are each provided with a support (d) for imparting a slight upward bias to their respective sealing lips, thereby preventing the sealing area of each lip from dipping downwardly into the case opening. As previously indicated herein, each support (d) extends along the entire length of the case opening.

The support is interrupted as often as possible by transverse grooves so that any contamination, e.g. sand, which might enter can be washed out by the water, so that the spring-back of the seal into the closed position is not obstructed.

The mounting area (c) of the sealing lip profile is not decisive for its function and is therefore not described in any detail. It should be designed in such a way as to allow for a firm hold on the surfboard and a mass-produced fit into the bottom of the board without any transition.

Good restoring power of the spring area (b) is the condition for the perfect functioning of the sealing lip assembly. This restoring power is ensured even in the case of lasting stress (e.g. pivoted out centerboard position) by the selection of certain materials or combinations of materials. The cross-section of the profile is designed in such a way that the spring force of the spring area, while the stability is sufficient, is as small as possible so that the centerboard can be easily moved.

The sealing area (a) of the sealing lip profile is designed in such a way that the frictional resistance between the centerboard and the seal is as small as possible (small contact surface, low coefficient of friction of the material). Furthermore, the sealing area (thick area of the profile) ensures a sufficient bias of the sealing lip on the longitudinal axis when the centerboard is pivoted out, so that the sealing lips rise up against the pivoting direction when the centerboard is pivoted in.

The material used for the sealing lips may be a glass-, carbon- or other fiber-reinforced synthetic material. A spring steel/synthetic material combination may also be used for this profile, whereby the perforated spring steel (FIG. 6) ensures the necessary restoring power and the synthetic material (e.g. polyethylene) is responsible for the sliding and stability properties, the possibility of mounting the spring steel and encasing it.

The assembly in FIG. 3 is made of hard, brittle synthetic materials and biassed on the inside with an elastic synthetic material or rubber (e).

FIG. 4 shows a variant of a spring steel/synthetic material profile which to a very great extent prevents the sealing lips from being pressed into the centerboard case.

The upper profile part (f) ensures a continuous transition from the sealing area to the mounting portion of the profile and is designed in such a way as to offer little resistance in the pivoting-out direction.

In the pivoting-in direction the upper profile part is subjected to tension beyond the closed position of the sealing lips, thereby preventing the sealing lips from being pressed into the centerboard case.

The sealing lip has in the sealing area a thickness of 0.2–5 mm, preferably 0.5–2 mm, and a length perpendicular to the longitudinal direction of 0.2–15 mm, preferably 3–8 mm.

The sealing lip has in the spring or resilient area a thickness of 0.05–3 mm, preferably 0.1–1.0 mm, at the transition to the sealing area, and a thickness of 0.05–10 mm, preferably 0.1–1.0 mm, at the transition to the mounting portion.

The length of the spring or resilient area is 10–60 mm, preferably 15–30 mm.

The transition from the resilient area to the sealing area and to the mounting portion is continuous.

The sealing side of the sealing area has a radius of 0.1–2.5 mm, preferably 0.3–1.0 mm.

The resilient area of the sealing lip is biassed opposite to the pivoting out direction, preferably with a radius of 10–100 mm.

The inside portion of the resilient area of the sealing lip is provided with an elastic synthetic material or rubber with a thickness of 0.1–3 mm.

The sealing lip has a spring band steel insert with a thickness of 0.05–0.5 mm, preferably 0.1–0.2 mm, and a width of 10–60 mm, preferably 30–50 mm.

The spring band steel insert is provided with slots perpendicular to the longitudinal axis spaced at 5–30 mm.

The slots have a length of 10–50 mm and a width of 1–25 mm, preferably 5–15 mm, in the sealing area and a width of 1–15 mm, preferably 4–8 mm, in the mounting area.

I claim:

1. A sealing lip assembly for sealing the underwater side of centerboard or variable keel fin systems on surfboards or sailboats, the centerboard or keel fin system being provided with a case in which a centerboard or keel fin is movably mounted such that, in a retracted position, the centerboard or keel fin is at least partially retracted from the underwater side and, in an extended position, the centerboard or keel fin fully protrudes from the underwater side, which sealing lip assembly comprises:

(a) two resiliently flexible sealing lips for closing an underwater opening of the case in a virtually flow-tight and non-vortical manner in every position of the centerboard or keel fin, the lips riding at least in the extended position of the centerboard or keel fin with a frontward sealing area on a respective surface of the centerboard or keel fin;

(b) the sealing lips being mounted with a rearward mounting area on the surfboard or sailboard adjacent to the underwater opening of the case so that, in the retracted position of at least a portion of the centerboard or keel fin, each sealing lip is slightly biased by a support located on the underwater side of the case; and (c) each support extending as far as the opening of the case and being interrupted by grooves for conducting water to wash out any contamination which might obstruct the resilient movement of the sealing lips into their closed position.

2. A sealing lip assembly according to claim 1, wherein said sealing lips are made from fibre reinforced synthetic material and are profiled such that (i) in its sealing area thickness is in the range of 0.2–5 mm and length is in the range of 3 to 8 mm, (ii) in a resilient area interposed between the respective mounting area and the thickness is in the range of 0.05 to 3.0 mm at the transition to said sealing area and a thickness of 0.05 to 10 mm at the transition to said mounting area, and length is in the range of 10 to 60 mm, (iii) the sealing side of said sealing area has a radius in the range of 0.1 to 2.5 mm, and (iv) the resilient area is biased opposite to the pivoting out direction with a radius in the range of 10 to 100 mm.

3. A sealing assembly according to claim 2, wherein said fibre reinforced synthetic material is a glass carbon material.

4. A sealing lip assembly according to claim 1, wherein each sealing lip is provided with an elastic synthetic material at an inner portion of said resilient area.

5. A sealing lip assembly according to claim 1, wherein said sealing lips have a spring band steel insert with a thickness in the range of 0.05 to 0.5 mm and a width in the range of 10 to 60 mm.

6. A sealing lip assembly according to claim 5, wherein said spring band steel insert is provided with slots being oriented normally to the longitudinal axis of the respective sealing lip.

7. A sealing lip assembly according to the claim 6, wherein said slots have a greater length and width in said sealing area than in said mounting area.

8. A sealing lip assembly for sealing the underwater side of centerboard or variable keel fin systems on surfboards or sailboats, said centerboard or keel fin systems having each a case in which a centerboard or keel fin is movably mounted such that in a retracted position the centerboard or keel fin is at least partially retracted from said underwater side and in an extended position the centerboard or keel fin is fully protruding from said underwater side, the sealing lip assembly comprising two sealing lips being mounted with a respective mounting area on said surfboard or sailboat adjacent to an underwater opening of said case such that (i) in said retracted position of the centerboard or keel fin the sealing lips at least partially close said opening, and (ii) in said extended position of the centerboard or keel fin the sealing lips are resiliently deflected thereby each riding with a sealing area on a respective surface of the centerboard or keel fin, each sealing area being flexible in a direction corresponding to the longitudinal axis of the respective sealing lip, wherein a resilient area is interposed between the respective mounting area and the respective sealing area of each sealing lip, with each resilient area being resilient in a direction normal to the longitudinal axis of the respective sealing lip, thereby being biased oppositely to the direction of its deflection, and each sealing lip being provided with a spring band steel inssert, with each insert having slots oriented normally to the longitudinal axis of the respective sealing lip, and wherein the slots have a greater width in said sealing area than in said mounting area.

* * * * *